US005608311A

United States Patent [19]

Innes et al.

[11] Patent Number: 5,608,311

[45] Date of Patent: Mar. 4, 1997

[54] AC INPUT FOR DIGITAL PROCESSOR WITH CAPACITIVELY COUPLED IMMUNITY AND SURGE WITHSTAND

[75] Inventors: Mark E. Innes; John H. Blakely, both of Asheville, N.C.

[73] Assignee: Eaton Corporation, Cleveland, Ohio

[21] Appl. No.: 545,068

[22] Filed: Oct. 19, 1995

[51] Int. Cl.[6] ..... G05F 1/00; G05F 1/70; G05F 3/00; G05F 5/00

[52] U.S. Cl. ..... 323/218; 323/219

[58] Field of Search ..... 323/218, 219, 323/367, 370; 363/155, 156; 361/56, 91, 111, 113, 118

[56] References Cited

U.S. PATENT DOCUMENTS

| | | | |
|---|---|---|---|
| 2,961,532 | 4/1957 | Rowley . | |
| 3,130,362 | 4/1964 | MacMillan . | |
| 4,634,814 | 1/1987 | Pommer, II | 379/377 |
| 4,725,767 | 2/1988 | Mori | 323/218 |
| 4,748,343 | 5/1988 | Engel | 307/135 |
| 4,750,100 | 6/1988 | Ragsdale | 363/86 |
| 4,843,515 | 6/1989 | Richman | 361/58 |
| 5,394,018 | 2/1995 | Elms | 307/134 |
| 5,483,406 | 1/1996 | Bennett et al. | 361/56 |

*Primary Examiner*—Peter S. Wong
*Assistant Examiner*—Bao Q. Vu
*Attorney, Agent, or Firm*—Larry G. Vande Zande

[57] ABSTRACT

A circuit for inputting an ac signal to a digital processor includes a capacitor connected to the input and ground. A rectifier, preferably a transient voltage suppression device, permits the capacitor and also the stray capacitance which couples false signals to the input lead, to charge to one polarity only. A shunt resistor discharges the capacitor on half cycles of opposite polarity, but there is no discharge path for the stray capacitance which therefore charges up to block steady state false ac signals. Series resistors between the rectifier and the input determine, together with the shunt resistor, the minimum input signal level and increase the over surface breakdown voltage to protect the input from transient voltage conditions. A resistor connected between the series resistors and the rectifier, and to ground determines the charging rate of the stray capacitance. The TVS device provides high transient voltage withstand and breaks down without damage in the event of large transients. The signal applied to the digital processor, which is clipped to logic level by clamping diodes on the input, is checked by the digital processor for magnitude and frequency compatible with a true input signal.

6 Claims, 2 Drawing Sheets

AC INPUT FOR DIGITAL PROCESSOR WITH CAPACITIVELY COUPLED IMMUNITY AND SURGE WITHSTAND

BACKGROUND OF THE INVENTION

1. Field of the Invention

This invention relates to ac inputs for digital processors and more particularly to such an input which rejects false signals created by stray capacitance, and which also provides high voltage transient withstand.

2. Background Information

Typically, digital processors utilize analog-to-digital converters to convert ac signals to digital, logic level signals for input to, and use by, the processor where the magnitude of the ac signal is of interest. In some applications, certain ac input signals are applied directly to the processor, such as where the ac signal is used as a logic input and its absolute magnitude is not of interest. The input circuits within a digital processor used in these applications, have clamping diodes which clip the half cycles of the ac waveform to the logic level used by the processor, for instance about 5 volts. For 120 volt ac signals, this produces an input signal that basically looks like a square wave. However, similar large ac signals on adjacent leads can be capacitively coupled to the lead connected to the ac input resulting in false inputs to the digital processor. The capacitive coupling is typically a result of poor wiring techniques, but cannot always be eliminated.

One application in which such direct input of ac signals to a digital processor is used is an electrical contactor or starter where 120 volt ac control signals are applied to ac input of a microprocessor in a digital control for the device. These control signals can be generated by "start" and "stop" push buttons located a distance from the processor necessitating long leads which are subject to capacitive coupling. The false signals can be derived from signals of higher voltage than the control voltage and even of different frequency from the true signal. It is common to use the phase angle and the magnitude of the signal on the input to detect the coupling of false inputs. However, as the phase and the voltage or frequency of the coupled signal vary, holes in the capacitive detection develop, and nuisance signals are accepted. It is not possible to insure that the end user will follow accepted wiring practices which would minimize such false signals.

Therefore, there is a need for an improved ac input for a digital processor with reduced susceptibility to capacitively coupled false signals.

There is a further need for such an ac input with a high voltage transient withstand capability.

There is a need for such an improved ac input for digital processors which does not require phase measurement.

There is also a need for such an improved ac input for digital processors which is economical and easily implemented.

SUMMARY OF THE INVENTION

These needs and others are satisfied by the invention which is directed to apparatus for inputting an ac signal into an input of a digital processor over an input line subject to stray capacitance. This apparatus includes rectifier means connected in the input line adjacent the input for charging up the stray capacitance with a dc voltage. A capacitor is connected to the input line between the input and the rectifier means and to a common reference potential to which the digital processor input is also referenced. A shunt resistor is connected across the capacitor. The capacitor and the shunt resistor are selected such that the capacitor charges on half cycles of the ac voltage signal which forward bias the rectifier means and discharges through the shunt resistor on opposite half cycles of the ac voltage signal. Thus, the input tracks the real ac signal. However, the stray capacitance has no similar discharge path and there is full immunity from steady state false ac signals.

Preferably the rectifier means is a transient voltage suppression device. Also preferably, a series resistor is provided between the rectifier means and the input to the digital processor through which the capacitor is charged. This series resistor increases the over surface breakdown voltage and therefore protects the input under transient voltage conditions. This series resistor also forms a divider with the shunt resistor in order to set the minimum acceptable magnitude for an input signal to the digital processor. An additional resistor connected at one end between the rectifier means and the series resistor and at the other end to the reference potential sets the charging rate for the stray capacitance.

Internal diodes on the input to the digital processor limit the voltage of the input signal. The time duration of the input signal is compared by the processor to the duration of a valid signal in the frequency range of operation. Hence, the digital processor will respond only to signals of the correct magnitude and frequency.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

The invention is directed to apparatus for inputting ac signals into a digital processor in a manner which discriminates between a true signal and a false signal. It will be described as applied to a motor control circuit, but it will be appreciated that it has wide application for inputting ac signals to digital processors utilized in many other applications.

Figure 1:
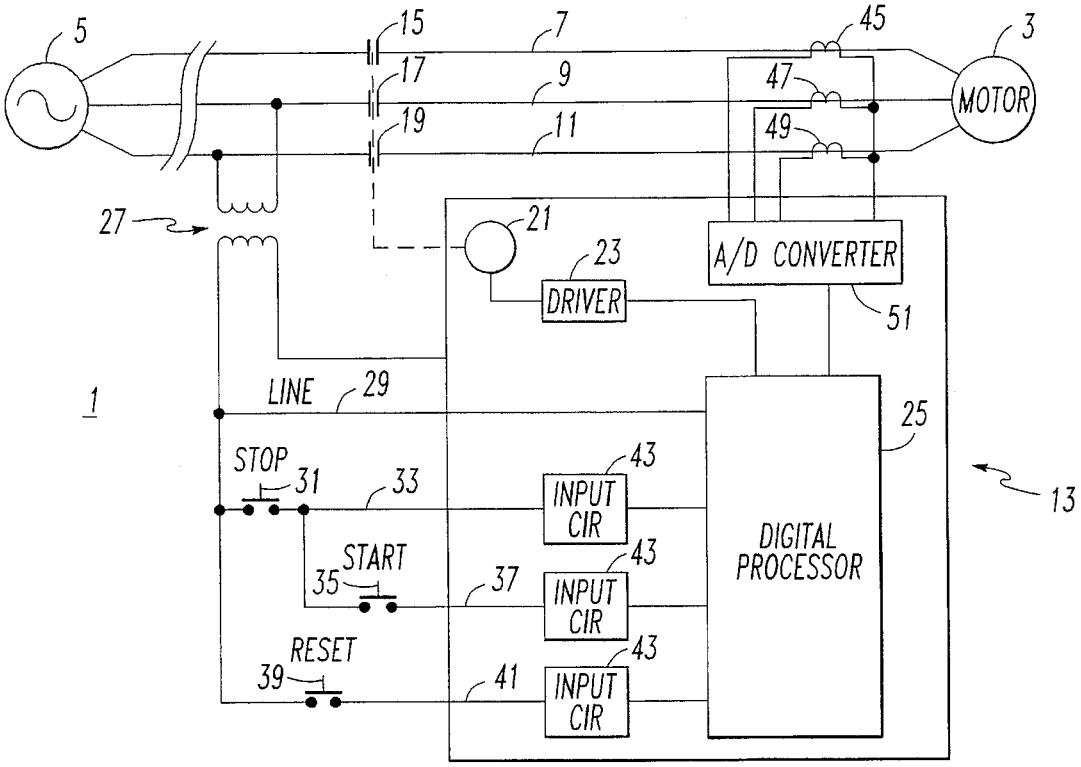
FIG. 1 is a schematic diagram of a motor control system incorporating the invention.

Referring to FIG. 1, a motor control system 1 connects a three-phase ac motor 3 to an electric power source 5 which provides three-phase power on leads 7, 9 and 11. The motor control system 1 comprises a motor starter 13 which combines the function of a contactor and an overload relay as is known in the art. The motor starter 13 has contacts 15, 17 and 19 connected in the leads 7, 9, and 11 respectively, for selectively connecting the motor 3 to the ac source 5. The contacts 15, 17, and 19 are closed by an electromagnet 21 which in turn is energized by a driver circuit 23 under control of a digital processor 25.

Power for the motor starter 13 is provided by a voltage transformer 27 the primary winding of which is connected across two of the ac lines such as 9 and 11. A secondary winding the voltage transformer 27 provides a line voltage signal on a lead 29 to the motor starter 13. The transformer 27 also supplies control power for generating control signals for controlling the motor starter 13. Thus, the secondary of the transformer 27 provides power to a STOP push button 31 which provides a RUN PERMIT/STOP signal on lead 33. Power is also provided through the normally closed STOP push button 31 to a START push button 35 which generates a START REQUEST signal on lead 37. Finally, power is provided for a RESET push button 39 which provides a RESET signal on lead 41.

The signals on the leads 29, 33, 37 and 41 are applied to the digital processor 25. As discussed above, stray capacitance can result in the coupling of false signals into these leads which can lead to miss operation of the digital processor 25. Since as mentioned above, and as more fully discussed in connection with FIG. 2, the inputs to the digital processor 25 clip the 120 volt control signals at about 5 volts, the false signals which can typically be above 5 volts, will, without the invention, generate signals input to the digital processor of the same magnitude as the true signals. In order to discriminate between true signals and false ac signals, we have inserted input circuits 43 in the leads 33, 37 and 41.

In addition to responding to the signals on the leads 33, 37 and 41, the digital processor 25 also monitors the phase currents drawn by the motor. This is implemented by current transformers 45, 47 and 49 connected to measure the currents in the leads 7, 9 and 11, respectively. These analog currents are digitized by an analog to digital (A/D) converter 51 for input to the digital processor 25. If any of the phase currents exceed predetermined current/time characteristics, the digital processor deenergizes the coil 21 to open the contactors 15, 17 and 19 and disconnect the motor 3 from the source 5, as is well known.

Figure 2:
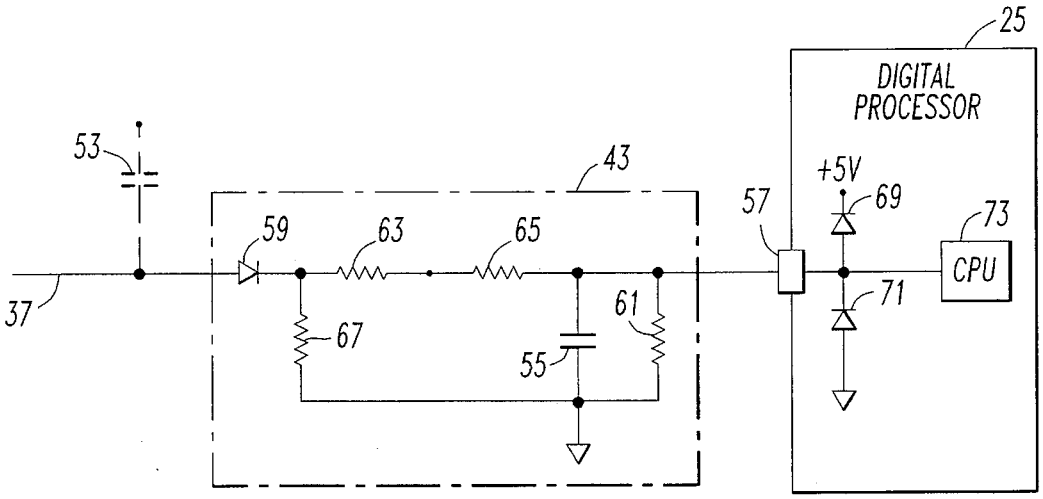
FIG. 2 is a schematic diagram of an input circuit in accordance with the invention utilized in the motor control system of FIG. 1.

FIG. 2 illustrates the details of the input circuits 43. As indicated, stray capacitance 53 can couple false signals onto the input leads, such as the lead 37. The input circuit 43 includes a capacitor 55 connected between an input terminal 57 to the digital processor 25 and to a reference potential common with the digital processor, which as shown in FIG. 2 is ground. A rectifier 59 connected to the lead 37 and the input 57 only permits the stray capacitance 53 and the capacitor 55 to charge to one polarity. A first resistor 61 shunting the capacitor 55, permits the capacitor 55 to discharge on the opposite polarity. Thus, the voltage across the capacitor 55, and therefore the voltage applied to the voltage input 57 follows the true signal applied on the lead 37. On the other hand, there is no path for discharge of the stray capacitance 53, so that the physical capacitors creating this stray capacitance 53 charge up and follow the applied stray voltage peak. A pair or resistors 63 and 65 connected in the lead 37 between the rectifier 59 and the input 57 form a voltage divider with the resistor 61 which determines the minimum signal level for input to the digital processor. A fourth resistor 67, connected between the diode 59 and resistor 63 and to ground, is the primary determinant of the rate at which the stray capacitance 53 charges. The smaller the resistor 67 the faster the stray capacitance 53 charges up. This charging rate is also affected to some extent by the values of the resistors 63 and 65.

Preferably, the rectifier 59 is a transient voltage suppression device (TVS) which provides a high voltage transient withstand. This device also breaks down without damage in response to very large transients. The series resistors 63 and 65 increase the over surface breakdown voltage and therefore protect the input 57 under transient voltage conditions. A single series resistor with suitable power dissipation capability could be used in place of the two resistors 63 and 65. The capacitor 55 also prevents the input from responding to small spikes and notches. In a typical application, the TVS 59 would have a breakdown voltage of about 400 volts. In installations where transients are known and controlled, diodes could be used as the rectifier 59.

FIG. 2 also illustrates the clamping diodes 69 and 71 connected to the input 57 of the digital processor 25. When the voltage at the input 57 exceeds the 5 volt bias applied to the diode 69, current is shunted through the diode 69 and the input signal is clipped at 5 volts minus the forward drop of the diode 69. This logic level signal is then applied to the CPU 73 in the digital processor 25. Negative half cycles of the ac signal applied to the input 57 are clipped at the forward drop voltage of the diode 71. Thus, the digital processor 25 in the example only responds to positive voltage input signals. The rectifier 59 is polled so that the positive half cycles of an ac signal on the lead 37 are applied to the input 57.

The circuit 43 completely eliminates steady state signals coupled by the stray capacitance into the line 37. The circuit 43 also attenuates transient signals coupled by the stray capacitance to the input line. However, in order to provide further protection against transient false signals, the processor examines the magnitude and the frequencies of the input signals. In the exemplary embodiment of the invention the frequency of the valid signals is compared with the frequency of the line voltage on the lead 29. If the frequency of a signal is not within a predetermined tolerance of the line frequency, the signal is rejected as being a false signal.

Figure 3:
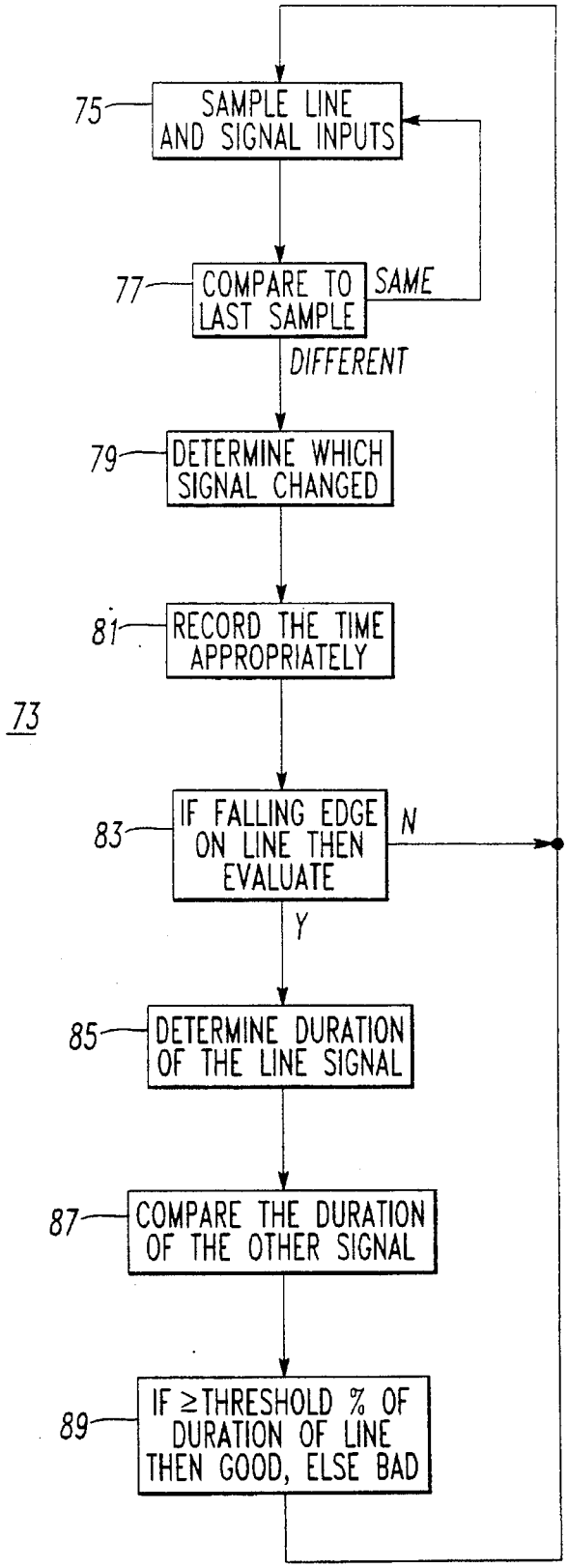
FIG. 3 is a flow chart of a program used by a digital processor which forms part of the circuits of FIGS. 1 and 2 which is used for discriminating between a true signal and a false input signal caused by stray capacitance.

A flow chart for a suitable routine 73 to implement this technique is shown in FIG. 3. As indicated at 75 the line voltage on lead 29 and the signals on leads 33, 35 and 41 are repetitively sampled and compared to the last sample of the corresponding signal at 77. If a predetermined difference in the magnitude of the samples is detected, the signal which changed in magnitude is identified at 79 and the time is recorded at 81. If the change detected was the falling edge of the line voltage, as determined at 83, indicating a zero crossing of the line voltage, then the duration of the line signal is determined at 85 using the time of the previous negative zero crossing of the line voltage. The duration of the signals on the leads 33, 35 and 41 are also calculated and compared to the duration of the line signal at 87. If the duration of a signal is more than or equal to a threshold percentage of the duration of the line voltage at 89 then the signal is good, otherwise the signal is rejected as being bad.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended, and any, and all equivalents thereof.

What is claimed is:

1. Apparatus for inputting an ac voltage signal into an input of a digital processor over an input line subject to stray capacitance, wherein said input and said input line are referenced to a common reference potential, said apparatus comprising:

rectifier means connected in said input line adjacent said input;

a capacitor connected to said input line between said input and said rectifier means and to said common reference potential; and a first resistor shunting said capacitor, said capacitor and first resistor being selected such that said capacitor charges on half cycles of said ac voltage signal which forward bias said rectifier means and said capacitor discharges through said first resistor on opposite half cycles of said ac voltage signal.

2. The apparatus of claim 1 wherein said rectifier means comprises a transient voltage suppression device.

3. The apparatus of claim 1 wherein said ac voltage signal has a given amplitude and a given frequency and said digital processor has clamping diodes on said input which clamp said ac voltage signal well below said given amplitude to produce an input signal, said digital processor further including means determining a duty cycle of said input signal and accepting said input signal as a valid representation of said ac voltage signal only when said input signal has a duty cycle within a selected range.

4. The apparatus of claim 1 further including a second resistor in series in said input line with said rectifier means between said rectifier means and said input and through which said capacitor charges.

5. The apparatus of claim 4 further including a third resistor connected to said input line between said rectifier means and said second resistor and also connected to said common reference potential and through which said stray capacitance charges.

6. The apparatus of claim 5 wherein said rectifier means comprises a transient voltage suppression device.

* * * * *